US007564980B2

(12) United States Patent
Zurek et al.

(10) Patent No.: US 7,564,980 B2
(45) Date of Patent: Jul. 21, 2009

(54) SYSTEM AND METHOD FOR IMMERSIVE SIMULATION OF HEARING LOSS AND AUDITORY PROSTHESES

(75) Inventors: Patrick M. Zurek, Arlington, MA (US); Joseph G. Desloge, Brookline, MA (US)

(73) Assignee: Sensimetrics Corporation, Somerville, MA (US)

( * ) Notice: Subject to any disclaimer, the term of this patent is extended or adjusted under 35 U.S.C. 154(b) by 922 days.

(21) Appl. No.: 11/111,036

(22) Filed: Apr. 21, 2005

(65) Prior Publication Data

US 2006/0239468 A1 Oct. 26, 2006

(51) Int. Cl.
*H04R 25/00* (2006.01)

(52) U.S. Cl. ..... 381/60; 381/314

(58) Field of Classification Search ..... 381/60, 381/312, 314, 320; 600/25, 559; 607/56, 607/57

See application file for complete search history.

(56) References Cited

U.S. PATENT DOCUMENTS

| | | | | |
|---|---|---|---|---|
| 6,620,093 | B2 * | 9/2003 | Waldmann et al. | 600/25 |
| 6,674,862 | B1 * | 1/2004 | Magilen | 381/60 |
| 2003/0167077 | A1 | 9/2003 | Blamey et al. | |

OTHER PUBLICATIONS

Anonymous, "Loudness recruitmen and hearing aids," RNID information Factsheets (Internet) (Nov. 25, 2004).

Anonymous, "What is Recruitment?" www.enterpregroup.com (Dec. 1, 2002).

Anonymous, Abstract of Hearing Loss and Prosthesis Simulator, Computer Retrieval of Information on Scientific Projects (Internet) (May 1, 2002).

Bonneau, A. and Mokhtar, P., "A platform for the diagnosis of auditory deficiency," HealthCom (Jun. 7, 2002).

Miller, C.A. et al., "Auditory nerve responses to monophasic and biphasic electric stimuli," Elsevier Science B.V. (2001).

Rubinstein, J.T., and Della Santina, C.C., "Development of a biophysical model for vestibular prosthesis research," J. Vestibul. Res. (Mar. 6, 2003).

White, R.L., "Review of Current Status of Cochlear Prostheses," IEEE Transaction on Biomedical Engineering (Apr. 1982).

Engebretson, A. et al., "Implentation of a Microprocessor-Based Tactile Hearing Prosthesis," IEEE Transactions on Biomedical Engineering (Jul. 1986).

* cited by examiner

*Primary Examiner*—Brian Ensey
(74) *Attorney, Agent, or Firm*—Wilmer Cutler Pickering Hale & Dorr LLP.

(57) ABSTRACT

An immersive hearing loss and auditory prostheses simulator allows a person who listens through the simulation system to experience an actual shift in his or her thresholds for detecting ambient sounds, in a way that is similar to the shift in thresholds experienced by a hearing-impaired person. The simulator shifts the listener's thresholds while also processing the input signals for suprathreshold stimulation. With a controlled degree of auditory threshold shift with loudness recruitment, a hearing loss simulator is made valid and flexible.

13 Claims, 7 Drawing Sheets

SYSTEM AND METHOD FOR IMMERSIVE SIMULATION OF HEARING LOSS AND AUDITORY PROSTHESES

STATEMENT OF GOVERNMENT INTERESTS

The inventions described here were made with government support under Grant No. 2R44 DC005446 awarded by the National Institute on Deafness and Other Communication Disorders. The government has rights in the invention.

BACKGROUND

Hearing loss may be due to many causes, but most result in hearing loss that is conductive or sensorineural. Conductive hearing loss is a condition in which sound cannot easily pass through the outer or middle ear. This may happen, for example, if the eardrum is damaged, the middle ear is infected or inflamed, or the small bones in the middle ear cannot vibrate freely. People with conductive hearing impairment find it difficult to hear quiet sounds well, but are able to hear clearly when sound is amplified.

Sensorineural hearing loss results from damage to the hair cells in the cochlea or in neural structures in the auditory system. People with sensorineural hearing loss cannot hear quiet sounds and may still have some problems hearing louder sounds comfortably and clearly. Typically sensorineural hearing loss is accompanied by a rapid growth in loudness as the sound level increases above the threshold of hearing. This rapid loudness growth is termed "recruitment."

Another frequent consequence of hearing impairment is tinnitus, which is a perceived ringing or buzzing in one or both ears. Even though the apparent loudness of tinnitus may be low, it can nevertheless be very annoying because it is constant.

In several audiological contexts, it is desirable to demonstrate the disabilities associated with hearing loss to a person with normal hearing. Parents of a hearing-impaired child, for example, find it instructive to experience their child's hearing and communicating difficulties. A hearing loss simulation can also vividly illustrate the need to speak clearly and to make one's face visible to a person with impaired hearing for lip-reading.

Hearing loss can be demonstrated with recordings of sounds that are processed to simulate what a hearing-impaired person would hear. These simulators can implement such processing in real-time, but do not convey to the listener a fundamental property of hearing loss, which is the inability to hear soft sounds. Stated differently, such hearing-loss simulations and demonstrations do not raise the listener's thresholds for ambient sounds by controlled amounts. Earplugs and muffs alone do not provide good hearing-loss simulation because they provide only a mild-to-moderate degree of hearing loss, and this loss is of the conductive type only.

SUMMARY

The systems and methods described here relate to achieving an immersive simulation of hearing loss and auditory prostheses. The term "immersive" in this context refers to the fact that the person who listens through the simulation system experiences an actual shift in his or her thresholds for detecting ambient sounds, in a way that is similar to the shift in thresholds experienced by a hearing-impaired person. The simulator shifts the listener's thresholds while also processing the input signals for suprathreshold stimulation. With a controlled degree of auditory threshold shift with loudness recruitment, a hearing loss simulator can be made both valid and flexible.

With such a simulator, the listener's thresholds can be verified to be shifted by a desired degree. When programmed, the simulator can flexibly simulate a wide range of hearing loss characteristics. The system can be made wearable and portable, allowing a listener to interact with real-world sound sources in any environment. The simulation can combine hearing aids and cochlear implants along with hearing loss to provide further understanding of prosthetic options. The simulator's immersibility and interactivity, along with extensive control of hearing loss and prosthesis characteristics, can give users improved insight into auditory communication problems and differences in perception when using a prosthetic device.

The foregoing features and advantages of the system and method for immersive simulation of hearing loss and auditory prostheses will be apparent from the following more particular description of embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

In the field of audiology, it can be desirable to demonstrate the communication difficulties that accompany hearing loss, as well as the improvements provided by prosthetic devices, mainly hearing aids and cochlear implants. Such demonstrations can be used (1) to train audiologists and educators of the deaf; (2) to educate people who work in high-noise settings, and the public generally, about the need for hearing protection and careful use of audio devices; (3) to help explain to family members of hearing-impaired and deaf persons the communication obstacles they face; and (4) to demonstrate options for prospective hearing-aid users.

Figure 1:
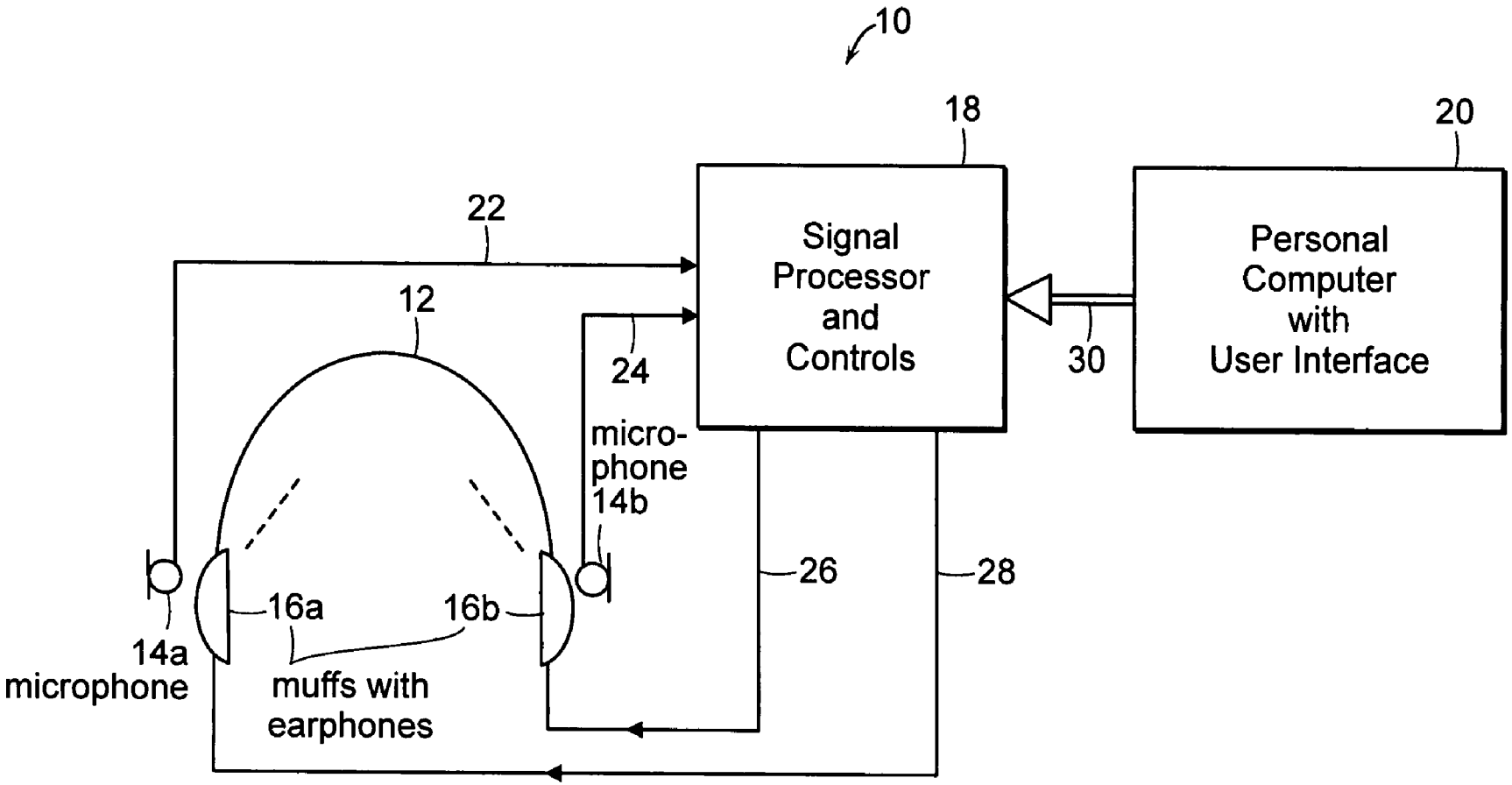
FIG. 1 is a schematic diagram showing the components of the hearing loss and prosthesis simulation system.

Referring to FIG. 1, in one embodiment, a hearing loss and prosthesis simulation system 10 includes a head-worn device 12 with binaural microphones 14*a*, 14*b* mounted on the outside of muffs that have respective earphones 16*a*, 16*b*. Microphones 14*a*, 14*b* receive ambient signals and provide them to a signal processing unit 18. Unit 18 processes signals based on selected characteristics, and provides processed signals 26, 28 to earphones 16*b*, 16*a*, respectively, and thus to the wearer of device 12. The signal processing is mainly performed with a programmable digital signal processor (DSP).

Signal processing unit 18 has controls that allow the listener to select from among a set of simulation options and to adjust the volume of a prosthesis. The simulation options include characteristics of the hearing loss and tinnitus for the two ears and of the prostheses at the two ears. The system includes an interface 30 to a personal computer 20 for specifying hearing loss and prosthesis characteristics. Unit 18 can be provided in a separate housing and connected to device 12 through one or more cables, or the functionality of unit 18 can be formed within a housing of device 12. A user interface for an audiologist can have controls and features that can be used to specify hearing loss and characteristics of the prosthesis.

In the embodiment illustrated in FIG. 1, the head-worn device 12 can be made from a modified hearing-protective headset. Headsets that have microphones that receive signals, process them, and provide them to a wearer are generally known for workers in loud environments when it is desirable, for example, to block the sound of machinery but allow people to hear speech (referred to as "hear-through" devices). There are many possible variants in these components, including other types of muffs, insert or behind-the-ear devices, or more than one set of microphones on each side.

Figure 2:
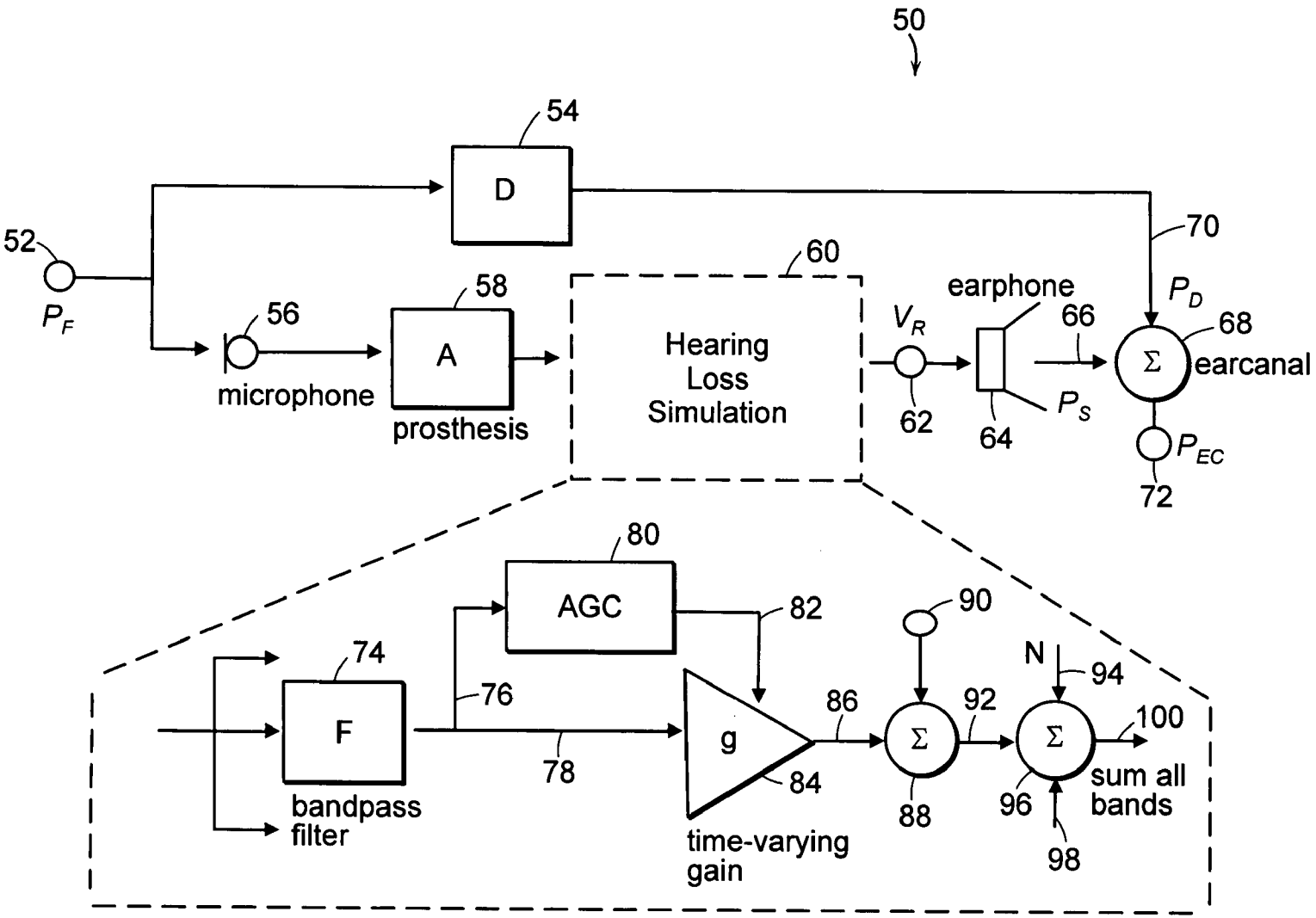
FIG. 2 is a functional block diagram showing the direct acoustic path to one ear (upper branch) and the processed path for a simulated prosthesis and hearing loss (lower branch) in accordance with an embodiment.

Referring to FIG. 2, a functional block diagram of a signal processing unit 50 for achieving the simulation is shown for one channel of the system. A sound-field signal $P_F$ 52 is picked up by a microphone 56 and is processed according to prosthesis 58 and hearing-loss simulation 60. The simulation output 62 is then delivered to an earphone 64, producing audible sound $P_S$ 66. Ideally, the muff or other protective device would block all sound, so the only sounds reaching the wearer's ear would be processed signals $P_S$ 66. In actual devices, however, some ambient sound typically gets through to the listener. This direct acoustic transmission to the listener's ear, denoted by the transmission path D 54 in FIG. 2, produces a direct component $P_D$ 70 that is added (represented by summer 68) to the earphone-delivered processed signals Ps 66 to result in the total sound pressure in the ear canal $P_{EC}$ 72. This addition of the direct-path sound disrupts the ability to control the sound at the listener's ear.

In this embodiment, the interference from the direct-path signal is reduced and ideally minimized to enable the simulator to control most of the sound delivered to the listener's ear. This reduction is achieved with a combination of attenuation from the headset device, additive masking noise, and automatic gain control (AGC). While all three approaches are used here, a system could use different combinations of strategies. To achieve frequency-specificity in both hearing-loss simulations and prosthesis simulations, the signal is processed in multiple frequency bands. The frequency bands may be, for example, the third-octave bands that are standard in audio analysis systems.

The expanded portion of FIG. 2 enclosed by dashed lines shows the signal processing performed in one frequency band of the hearing loss simulator. A bandpass filter 74, an AGC 80, and an amplifier 84 are connected via interconnents 76,78 and 82, In each band, as selected by the bandpass filter 74, the AGC 80 adjusts the gain of the amplifier 84 to produce an amplified output signal 86. Additive noise N 90 is introduced by the simulator via summer 88 to partially mask the direct-path signal 70. Processing in different frequency bands has the same form, but there can be different parameters for the AGC and additive noise depending on the frequency.The resulting signals from all of the frequency bands 94, 98 are summed together by summer 96 and output 100 to a D/A converter.

Figure 3:
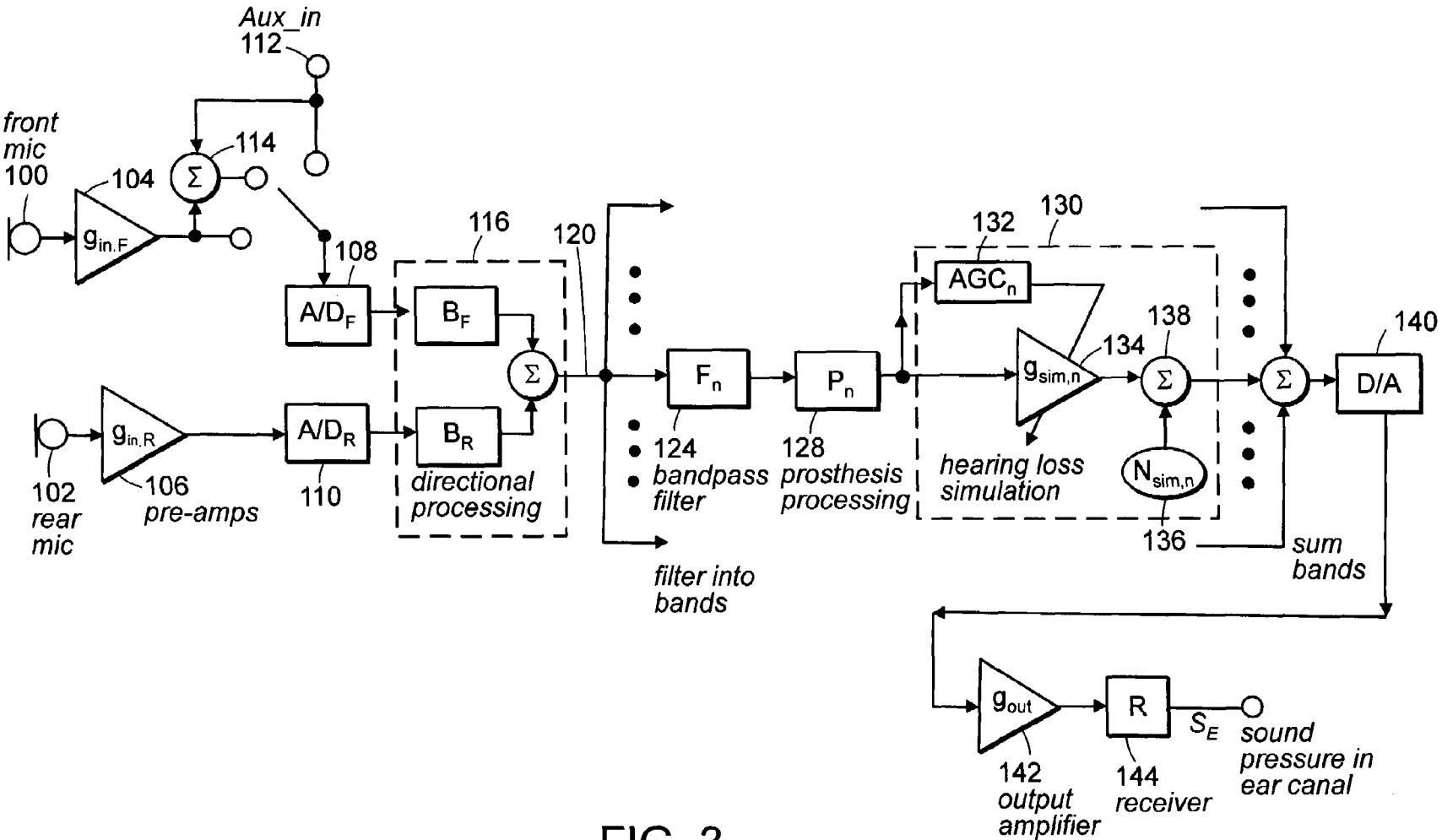
FIG. 3 is a detailed block diagram of the components and the signal processing within the simulation systems.

The circuitry of FIG. 2 is shown in more detail in FIG. 3. As shown here, each binaural microphone 14*a*, 14*b* (FIG. 1) has two microphones, shown here as front microphone 100 and rear microphone 102. These microphones provide signals to respective preamplifiers 104, 106 and then to analog-to-digital converters (ADC) 108, 110 to digitize the signals from the microphones. One of the microphones can have an auxiliary input 112 that is provided directly to ADC 108 or combined in a summer 114 with the amplified and received signal from front microphone 100. Such an auxiliary input is generally known already in the prior art in the field of hearing aids to allow sound to be provided directly to the device (e.g., for providing music).

The digital signals are processed and summed in a directional processing block 116. In a manner that is already known, block 116 can use additive, subtractive, and delaying techniques to provide directionality. This feature is also generally known for use with hearing aids.

A directional output signal 120 from block 116 is filtered into multiple bands with bandpass filters 124. The next steps would be performed for each of the separate bands, only one of which is shown. In prosthesis processing block 128, the signals can be processed in different ways to simulate different types of prosthesis. To simulate a hearing aid, the signals can be amplified, either linearly or with controlled gain depending on the level of the sound (referred to as "compression"). Processing for a cochlear implant is different. In this case, as is generally known, the envelope is removed from the signal to retain variations in the intensity of the sound, while removing changes in pitch.

The prosthesis-processed signals are provided to hearing loss simulation circuitry 130. The signals are provided to an AGC unit 132 that controls the gain of an amplifier 134. Additive noise 136, represented as $N_{sim,n}$ is provided to a summer 138 and added to the amplified signal to at least partially mask the direct path signal (shown as D in FIG. 2). The resulting signals from all of the frequency bands are summed together and converted to an analog signal by a digital-to-analog converter (DAC) 140. The resulting analog signal is provided to an output amplifier 142 and a receiver 144 to produce the signal in the ear canal.

Figure 4:
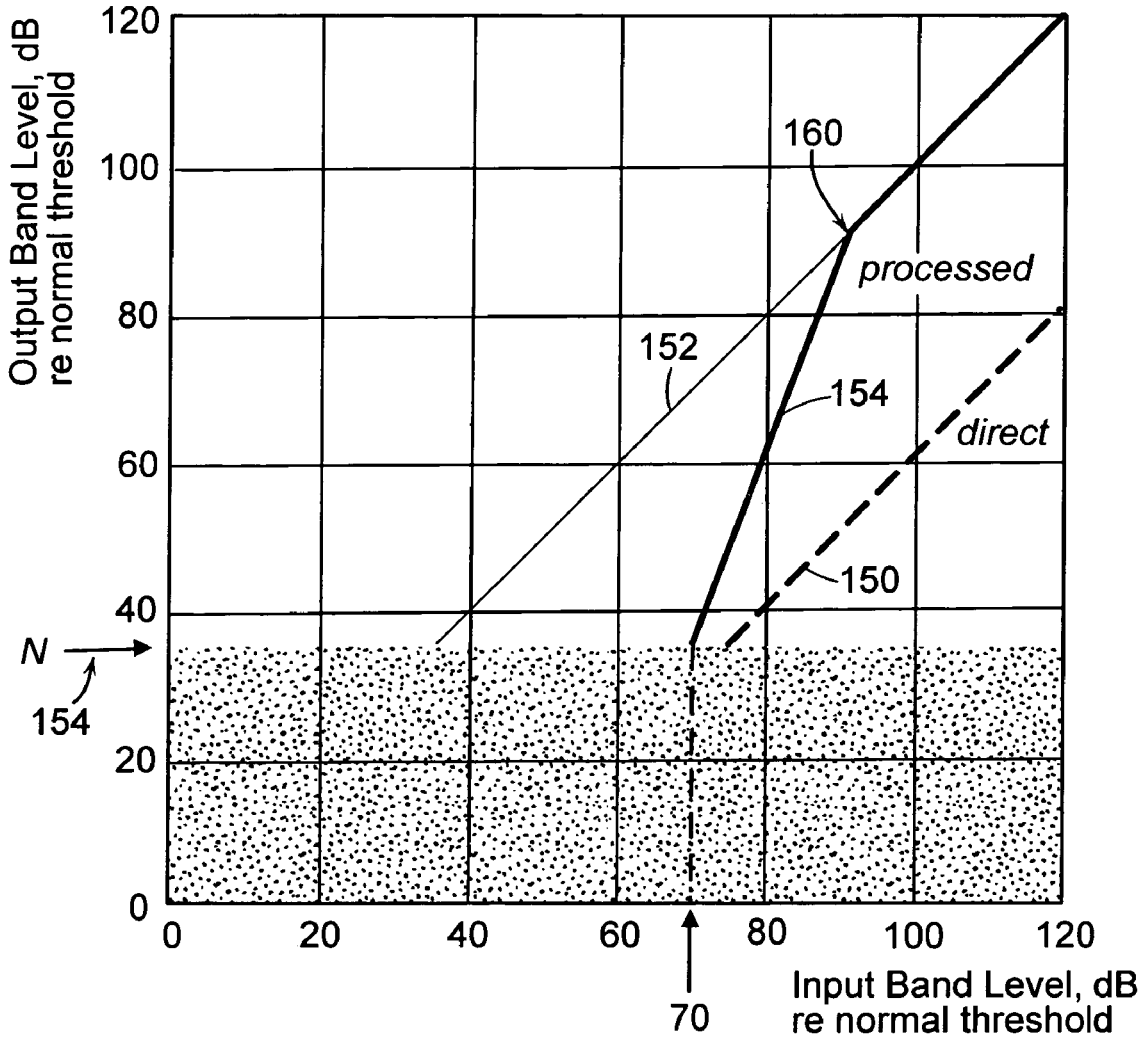
FIG. 4 graphically illustrates an input/output sound level characteristic showing signal components—a direct-path signal, a processed simulator output signal, and simulator noise N—in one frequency band of the hearing-loss simulator, wherein the decibel scales are referenced to normal absolute threshold.

FIG. 4 is a graph that illustrates how the AGC and additive noise level are used. FIG. 4 illustrates the input/output characteristics of the main sound pressure components in one frequency band in the listener's ear canal. The direct path signal $P_D$ is shown as line 150, the AGC output signal as line 152, and the simulator noise N as 154. The decibel scales are referenced to normal absolute threshold. The direct-path component line 150, in this example, is assumed to be attenuated 40 dB (the x-intercept is at 40 dB) relative to the response with the ear open (i.e., when no hearing protector is used). The processing in each band and the addition of the masking noise are designed to shift an absolute threshold for ambient sound by a desired amount while also masking the direct component. The threshold shift is accomplished by causing AGC output line 154 to emerge above noise level N at a threshold shift which, in this example, is 70 dB. AGC output line 154 and the noise level N are chosen to intersect a few decibels above the point where the direct-path and processed components intersect.

When the input signal level is at or below the shifted input threshold (70 dB in this example), the direct component is masked by noise level N. As the input level increases and exceeds the shifted threshold, both the processed and direct components rise above the noise-masked threshold. However, because the processed component is larger than the direct component shown as line 150, the processed component dominates the total ear-canal sound pressure in that frequency band. n this embodiment, the AGC output characteristic has two straight-line segments caused by the gain set by the AGC, although the output could have more segments. The recruiting part of the processed curve (the part below a knee point 160) has variable gain such that the function rises from an output level of N (or from 0 dB if N is below 0 dB) to full recruitment (i.e., the knee point) over a recruitment range of approximately 20 dB. The second line segment of the AGC characteristic (the part above the knee point 160) extends from the knee point upwards with a fixed gain. The gain of the first segment is greater than the gain of the second segment, and the slope of the second segment is, in this embodiment, equal to one. As a result, the additive noise causes the wearer to have substantially no perception of the received signal below a first threshold input level, as is typical for one with conductive or sensorineural hearing loss. As the input level rises above a threshold (e.g., 70 dB), there is a rapid increase in the AGC output characteristic, which simulates the loudness recruitment that accompanies sensorineural hearing loss. Above a next threshold (e.g., 90 dB), the slope of the AGC characteristic goes to 1, reflecting the fact that loudness has fully recruited.

The time-varying gain in the band is generated from the equations for the line describing the processed components as a function of the input-level estimate. The input level estimate is obtained, for example, from a time-average of the square of the bandpass-filtered microphone signal. In one embodiment, an exponential average of input level is made with a time constant of, for example, 14 msec.

Figure 5:
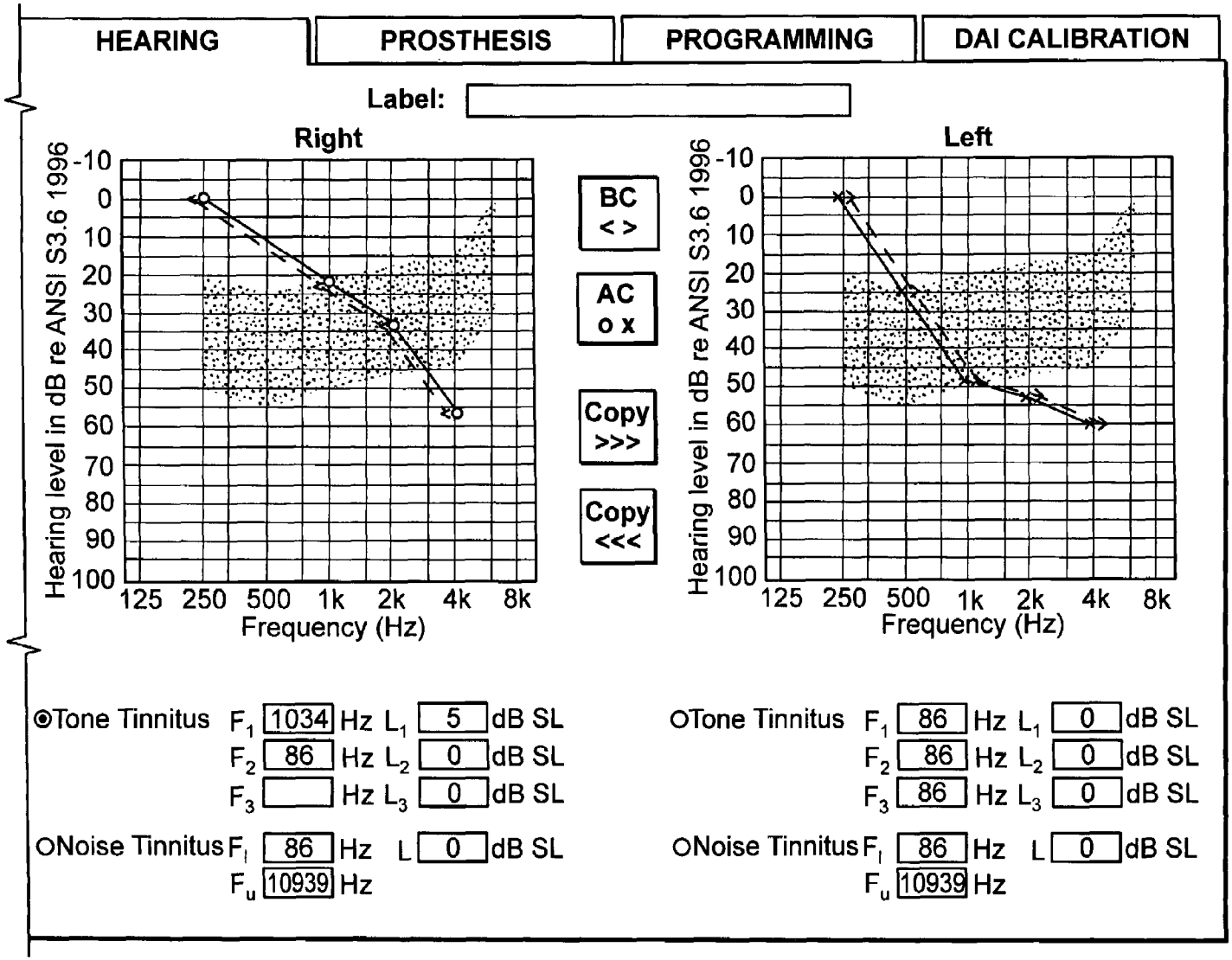
FIGS. 5 and 6 are screen shots of a user interface for specifying hearing and prosthesis characteristics, respectively.
Figure 6:
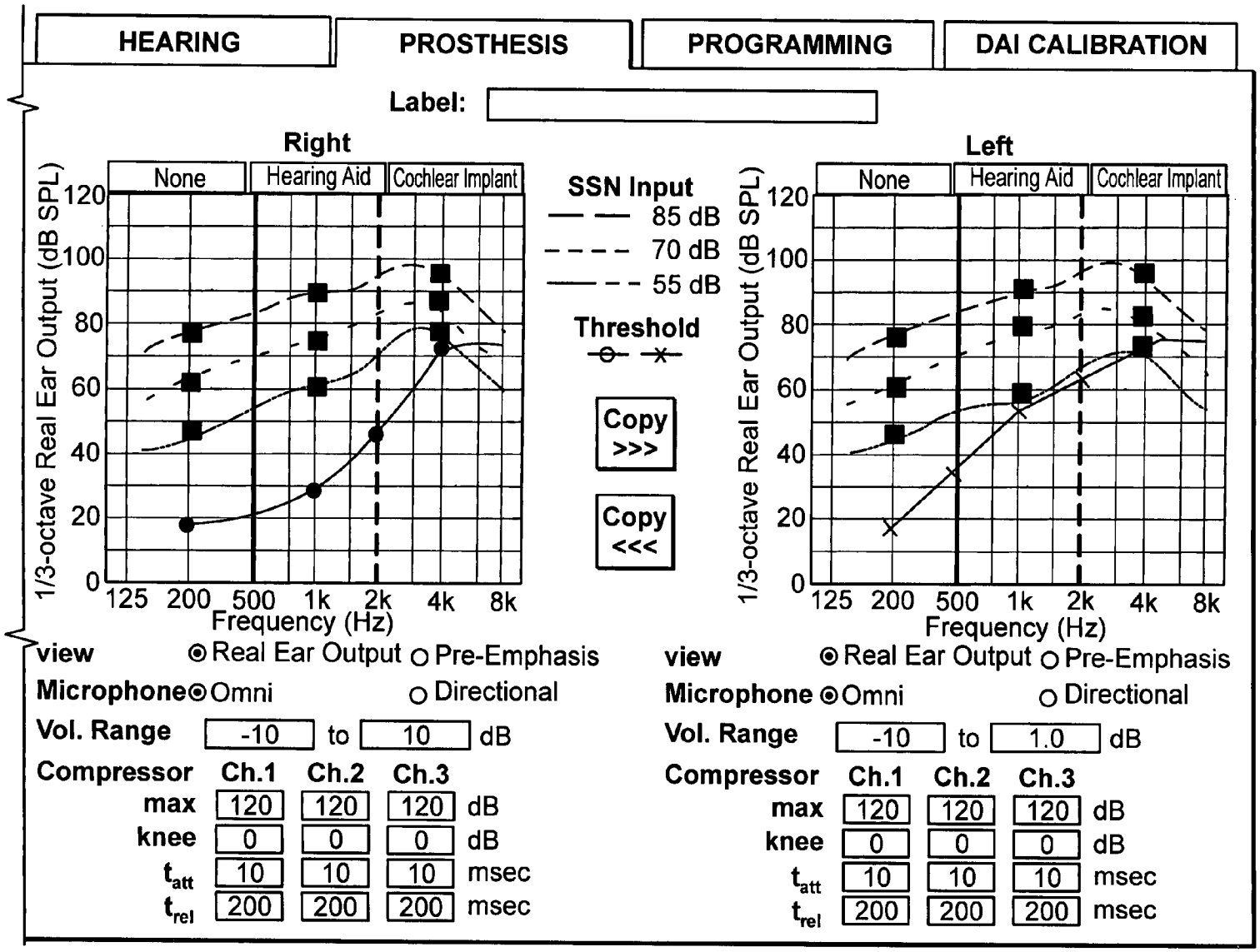

FIGS. 5 and 6 show exemplary screen shots for a user interface. FIG. 5 shows user inputs for specifying hearing loss and tinnitus for a simulation, while FIG. 6 shows user inputs for specifying a prosthesis, in this case a linear hearing aid. As shown in FIG. 5, the audiologist user has a wide range of controls, including setting the bone-conduction and air-conduction thresholds for each ear, and providing characteristics for tinnitus. The audiologist user can also specify types of prostheses, such as linear hearing aid as shown, and also compression hearing aids and cochlear implants.

Using a software interface at a personal computer, the operator can create a set of hearing specifications and a set of prosthesis specifications for simulation. These specifications are then downloaded to the signal processor, possibly by way of a remote control device. The operator would then give the simulator headset to the user to wear, along with instructions for use. Different combinations of hearing and prosthesis specifications can then be selected from the set of available specifications. This selection can be done by the wearer or by the clinician. The wearer experiences the threshold shifts accompanying hearing loss, and processing by the prosthesis, while being exposed to sounds in the environment.

Figure 7:
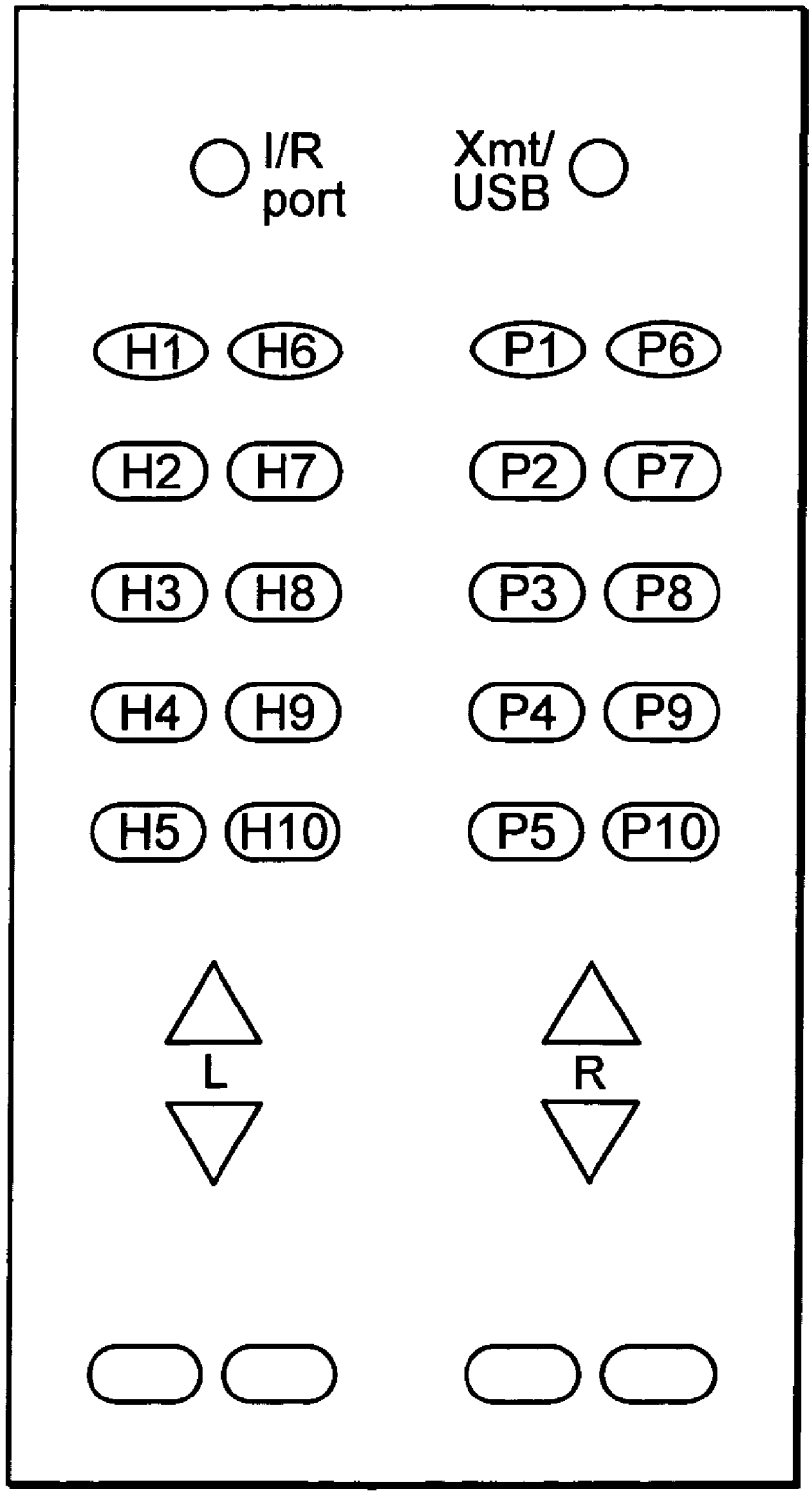
FIG. 7 is a plan view of a remote control for use with the system of FIGS. 1-3.

Referring to FIG. 7, a number of settings can be established and provided to a remote control. The operator can set up to ten hearing profiles (H1-H10) and up to ten prosthesis profiles (P1-P10).

In view of the wide variety of embodiments to which the principles of the present invention can be applied, it should be understood that the illustrated embodiments are exemplary only, and should not be taken as limiting the scope of the present invention. Various elements of the embodiments can be implemented in software, circuitry, other computer hardware or firmware, and any desired combinations.

It will be apparent to those of ordinary skill in the art that methods involved in the system for immersive simulation of hearing loss and auditory prostheses may be embodied in a computer program product that includes a computer usable medium. For example, such a computer usable medium can include a readable memory device, such as a hard drive device, a CD-ROM, a DVD-ROM, or a computer diskette, having computer readable program code segments stored thereon. The computer readable medium can also include a communications or transmission medium, such as a bus or a communications link, either optical, wired, or wireless, having program code segments carried thereon as digital or analog data signals.

Other aspects, modifications, and embodiments are within the scope of the following claims. For example, while the processing is preferably performed with a programmed DSP, any suitable circuitry or special or general purpose computing device, or combination of the foregoing, could be used.

What is claimed is:

1. A method for simulating hearing loss and auditory prostheses comprising:

processing a received signal indicative of an acoustic signal, including:

amplifying at least a portion of the received signal using automatic gain control (AGC); and adding noise to the adjusted signal;

wherein the added noise causes there to be substantially no perception of the received signal below a first threshold input level, the AGC amplifies the input signal with a variable gain above the first threshold input level up to a second threshold input level, and the AGC amplifies with a fixed gain above the second threshold input level.

2. The method of claim 1, further comprising dividing the signal into a plurality of spectral bands wherein the amplifying and adding are performed for each of a plurality of spectral bands.

3. The method of claim 1, wherein the processing shifts the user's absolute threshold for ambient sound by a controlled amount, the method further comprising verifying that the user's absolute threshold for ambient sound has been shifted by a desired controlled amount.

4. The method of claim 1, further comprising calculating a level of noise dependent on the degree of direct path attenuation.

5. The method of claim 4, wherein the direct path attenuation is about 40 dB.

6. The method of claim 1, wherein the simulation is performed on an individual wearing a device for providing the processing, the device including an interface for receiving parameters indicating thresholds.

7. The method of claim 6, wherein the interface further receives parameters indicating characteristics of tinnitus.

8. A system comprising a signal processor for performing the method of claim 1.

9. A system comprising a signal processor for performing the method of claim 2.

10. A system for simulating hearing loss and hearing prostheses, comprising:

a head worn device having binaural microphones and earphones;

a signal processing unit coupled to the microphones and earphones for processing a received signal indicative of an acoustic signal, the processing including:

amplifying at least a portion of the received signal using automatic gain control (AGC); and adding noise to the adjusted signal to cause there to be substantially no perception of the received signal below a first threshold input level, the AGC amplifying the input signal with a variable gain above the first threshold input level up to a second threshold input level, and the AGC amplifying with a fixed gain above the second threshold input level; and an interface to a computing device for specifying characteristics of hearing loss and prostheses.

11. The system of claim 10, wherein the head worn device is a hearing protective headset.

12. The system of claim 10, wherein the microphone is mounted on the outside of an ear-muff.

13. The system of claim 10, wherein the signal processing unit is a programmable digital signal processor.

* * * * *